US007743571B2

(12) United States Patent
Vagedes

(10) Patent No.: US 7,743,571 B2
(45) Date of Patent: Jun. 29, 2010

(54) INJECTION MOLDABLE COMPOSITE GABLE VENT

(75) Inventor: Michael Vagedes, Florence, KY (US)

(73) Assignee: Bluegrass Products, LLC, Florence, KY (US)

( * ) Notice: Subject to any disclaimer, the term of this patent is extended or adjusted under 35 U.S.C. 154(b) by 364 days.

(21) Appl. No.: 11/693,197

(22) Filed: Mar. 29, 2007

(65) Prior Publication Data

US 2008/0134609 A1 Jun. 12, 2008

Related U.S. Application Data

(60) Provisional application No. 60/869,465, filed on Dec. 11, 2006.

(51) Int. Cl.
*E04D 13/152* (2006.01)
*E04D 13/17* (2006.01)

(52) U.S. Cl. ..... 52/473; 52/198; 52/199; 52/302.1

(58) Field of Classification Search ..... 52/302.1, 52/198, 199, 473; 454/277
See application file for complete search history.

(56) References Cited

U.S. PATENT DOCUMENTS 2,803,185 A 8/1957 Coleman
3,120,082 A 2/1964 Mendelsohn
3,267,834 A * 8/1966 Hockett ..... 454/280
3,302,554 A 2/1967 Roussey et al.
4,875,317 A * 10/1989 Logan et al. ..... 52/208
4,875,318 A * 10/1989 MacLeod et al. ..... 52/211
4,899,647 A 2/1990 Garries et al.
5,255,486 A * 10/1993 Wang ..... 52/473
5,303,525 A 4/1994 Magee
5,349,799 A * 9/1994 Schiedegger et al. ..... 52/473
5,664,375 A * 9/1997 Ward ..... 52/97
5,673,526 A * 10/1997 Schiedegger et al. ..... 52/473
6,076,321 A * 6/2000 Holland ..... 52/473
6,360,508 B1 3/2002 Pelfrey et al.
6,468,151 B2 10/2002 Darcey
6,988,345 B1 1/2006 Pelfrey et al.

* cited by examiner

*Primary Examiner*—Brian E Glessner
*Assistant Examiner*—Jason Holloway
(74) *Attorney, Agent, or Firm*—Wood, Herron & Evans, L.L.P.

(57) ABSTRACT

A vent is formed from vent panels that can be formed by injection molding or vacuum forming. The vent panels include upper and lower edges. The upper edge includes a nailing flange and a channel. The channel is coplanar with the outer surface of a nailing flange. The lower edge is a linear flange adapted to fit within the channel of the next adjacent vent panel. The vent includes a lower trim member that has a flange and a channel coplanar with the upper surface of the flange and adapted to receive the bottom edge of a vent panel. The lower trim member is designed to attach to the upper edge of vinyl siding. J channels or T channels are used then to trim out the remaining portion of the vent. This allows one to form a custom vent by combining vent panels as desired.

5 Claims, 6 Drawing Sheets

INJECTION MOLDABLE COMPOSITE GABLE VENT

RELATED APPLICATION

This application is related to and claims the benefit of U.S. Provisional Patent Application Ser. No. 60/869,465, filed on Dec. 11, 2006, the disclosure of which is incorporated herein by reference.

BACKGROUND OF THE INVENTION

Gable vents are used on the walls of buildings, generally below the pinnacle of the roofline. There are many types of gable vents formed from various materials, such as metal, wood, and plastic. There are also a variety of different shapes and sizes of gable vents. Many of these are specifically designed for use with vinyl siding. Such structures are disclosed, for example, in U.S. Pat. Nos. 6,076,321 and 5,673,526.

Vents are generally assembled in a factory. A nonstandard-sized vent generally must be specially ordered. Specially ordered vents are very expensive. It also takes extra time to order and receive these. This can slow down a remodeling project.

Pending U.S. application Ser. No. 11/381,762, entitled, "Component Gable Vent", filed May 5, 2006, the disclosure of which is hereby incorporated by reference, discloses a gable vent that can be formed and assembled on site, utilizing pre-formed interlocking vent panels in combination with trim channels. The trim channels can be J channels, and used where the vent abuts another surface, such as a soffit, or can be T channels, where the vent abuts siding.

The vent panels disclosed in this application are very similar to vinyl siding. The bottom edges of the vent panels are inwardly curved to engage the upper surface of a section of the vinyl siding. The upper edge of the vent panels is the same as the upper edge of vinyl siding, with a nailing flange and a connecting channel. This allows the bottom edge of the vent panel to connect to the bottom edge of vinyl siding. This also allows adjacent vent panels to interlock, as well as adjacent sections of vinyl siding to interlock with the vent panels.

The disclosed vent panels must be formed by an extrusion process with subsequent post extrusion processing in order to form the venting. This post extrusion processing significantly increases the cost of the vent panels.

SUMMARY OF THE INVENTION

The present invention is premised on the realization that a component vent can be formed from injection molded vent panels. The vent panels include upper and lower edges with vented slat portions between the upper and lower edges. Vent openings in the bottom portions of the slats are perpendicular to the direction of the slats to facilitate molding. The upper edge of the panel includes a nail flange and a channel coplanar with the outer surface of the nail flange. This channel is adapted to receive the bottom edge of the next adjacent vent section. The component vent includes a bottom trim member having an upper edge configuration similar to the upper edge configuration of the upper edge of the vent panels and a lower curved edge adapted to interfit with or engage the upper edge of vinyl siding. The sides and upper edges of the component gable vent can be formed from either J channels or T channels.

The objects and advantages of the present invention will be further appreciated in light of the following detailed description and drawings in which:

DETAILED DESCRIPTION

Figure 1:
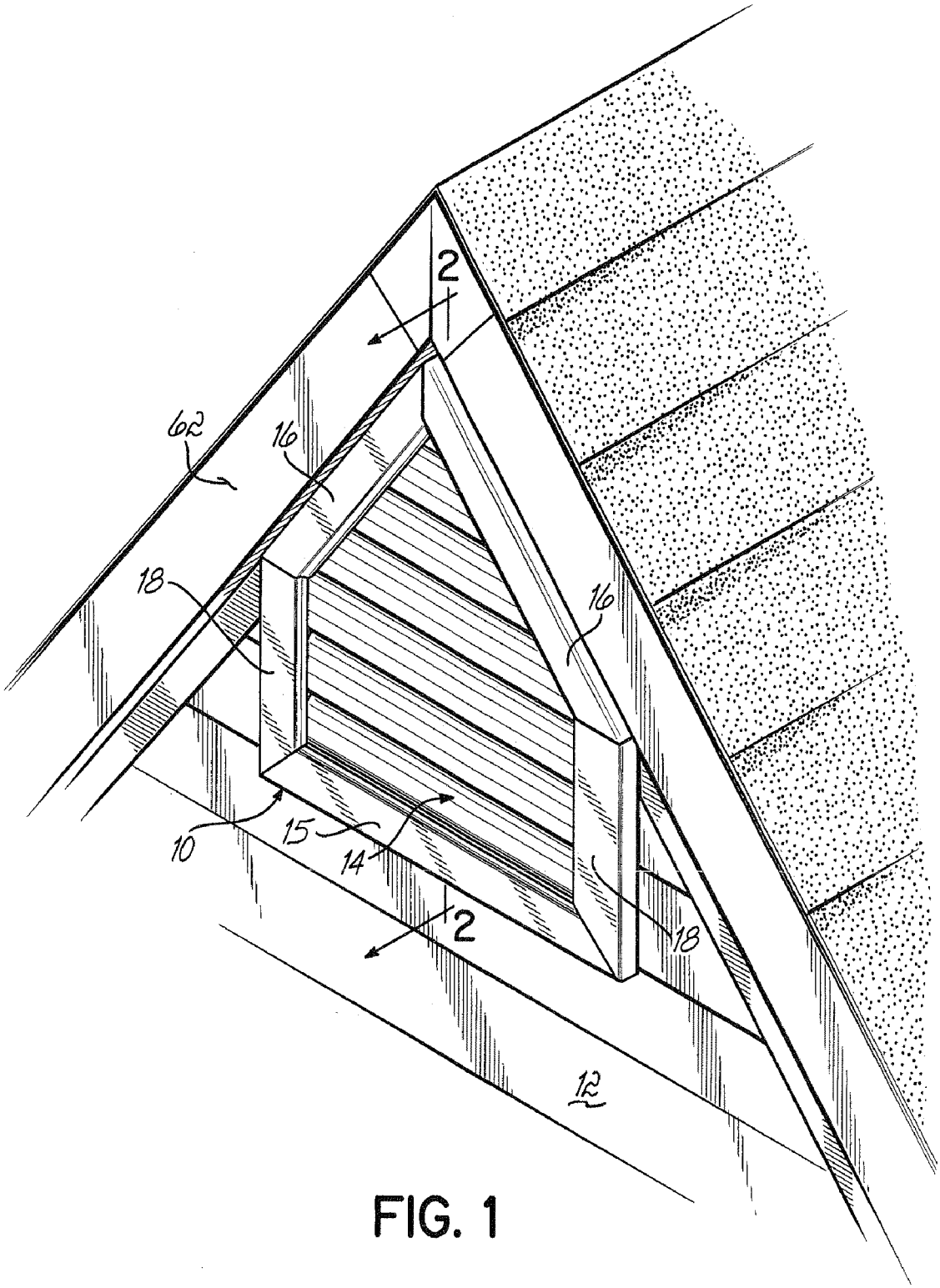
FIG. 1 is a perspective view of a building wall incorporating the present invention.

As shown in the Figures, a gable vent 10 is affixed to a building wall 12. The gable vent 10 includes slatted panels 14 surrounded by a lower trim section 15, as well as either sections of J channel 16 or, in certain cases, T channel 18.

The slatted panels 14 which can be formed by injection molding, include an upper edge 26 and a lower edge 28. The upper edge 26 includes an upper nail flange 30 and a channel 32 that is coplanar with the outer surface 33 of nail flange 30.

The slatted panels 14 include a plurality of slat members 34*a*, 34*b*, 34*c*. The slat members include an outwardly sloped portion 36 that leads to an inwardly extended portion 40 having a plurality of slots or vent openings 42. Portion 40 extends at least 90°, and preferably greater than 90°, relative to the back plane 41 of the panel, which allows the slots 42 to be formed by injection molding. The slots 42 are perpendicular to the direction of the slat members 34*a*, 34*b* and 34*c*.

Figure 2:
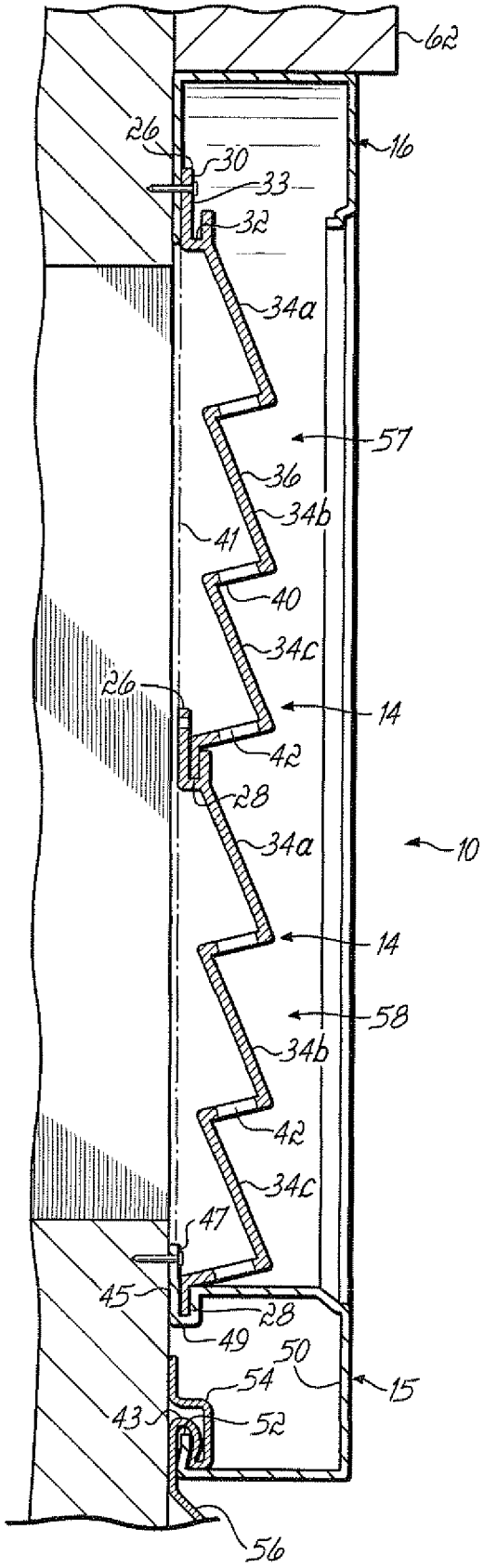
FIG. 2 is a cross sectional view taken at lines 2-2 of FIG. 1.

The bottom edge 28 of panel 14 mates with the upper edge 26 of an adjacent panel section by sliding into channel 32, as shown in FIG. 2.

An assembled vent 10 includes the slatted panels 14, which are surrounded by lower trim section 15, the J channel 16, and/or the T channel 18 sections, depending upon the design and location of the vent 10.

The lower trim section 15 is designed to engage the bottom edge 28 of the bottom vent panel section 14 and engage an upper edge 43 of siding. The upper edge 45 of trim section 15 includes a nailing flange 47 and a channel 49 coplanar with the exposed surface of the nail flange 47 identical to the upper edge 26 of panel 14. Trim section 15 further includes a body portion 50 and a lower inner edge 52 curved inwardly in the shape of a C and designed to engage an upper connecting edge 54 of vinyl siding 56, as shown in FIG. 2. This allows the lower trim member 15 to bridge between the upper run of vinyl siding 56 and the lower run 58 of a vent panel 14.

J channel sections 16 are employed to bridge between an upper edge 60 of the formed vent 10 and a solid surface such as a soffit 62 or trim member. T channels 18 are designed to bridge between a side surface of the panels 14 of the vent 10 and adjacent siding, as shown in FIG. 1, and can be employed to extend the width of the vent.

The T channels 18 include first and second opposed nail flanges 74 and 76 separated by a vertical central wall 78. Extended from the central wall is a first return portion 80 leading to a coved edge 82 and a second return portion 84 leading to a second edge 86. This provides two channels 87 and 89 to conceal the edge of the vent panels 14 on one side and the edges of siding on the opposite side.

The vent 10 is formed and affixed to a wall as the siding is being attached to the wall. Once the siding reaches the location where a vent is desired, the vent is formed.

Figure 3:
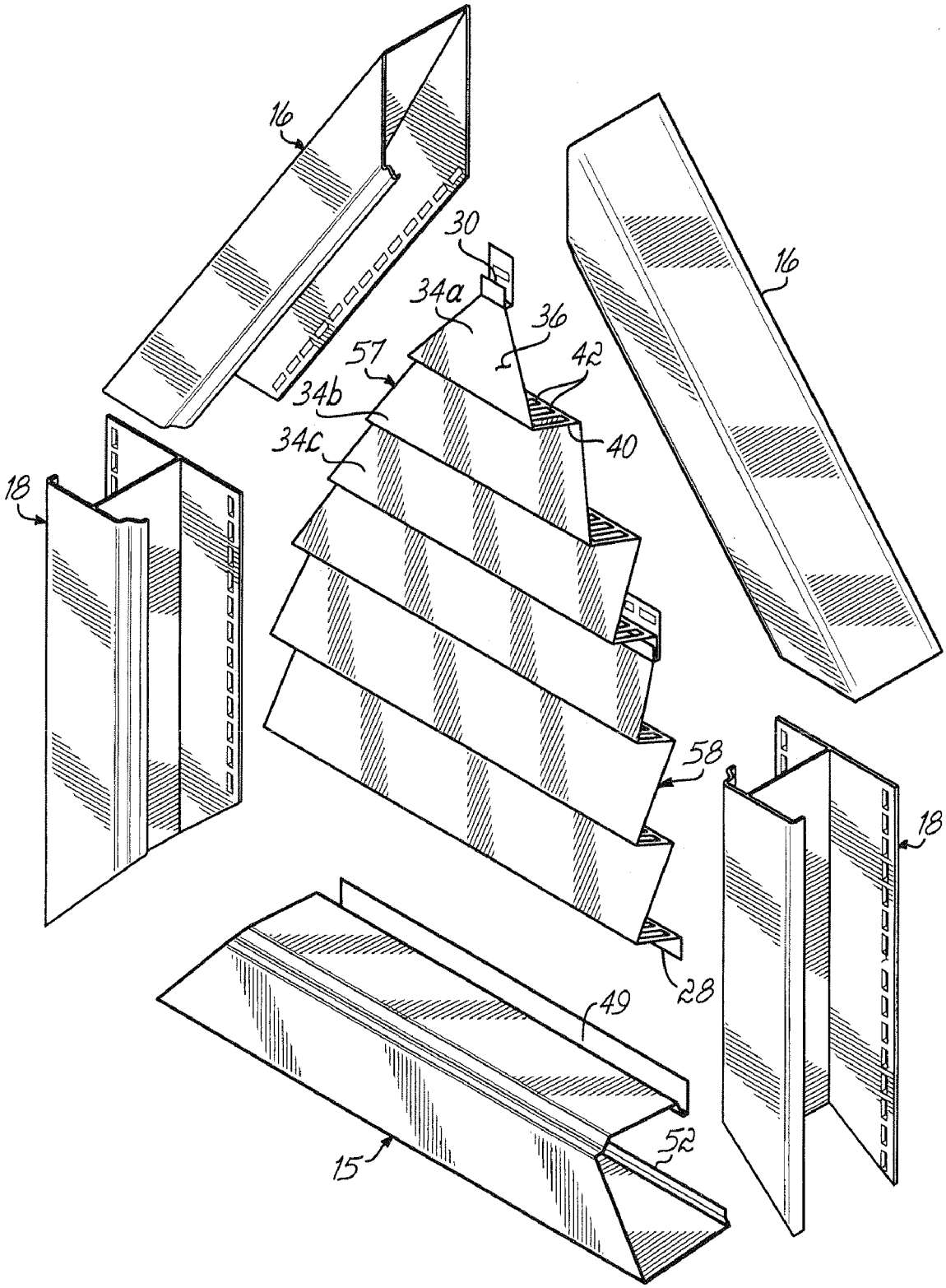
FIG. 3 is an exploded view of the present invention.
Figure 4:
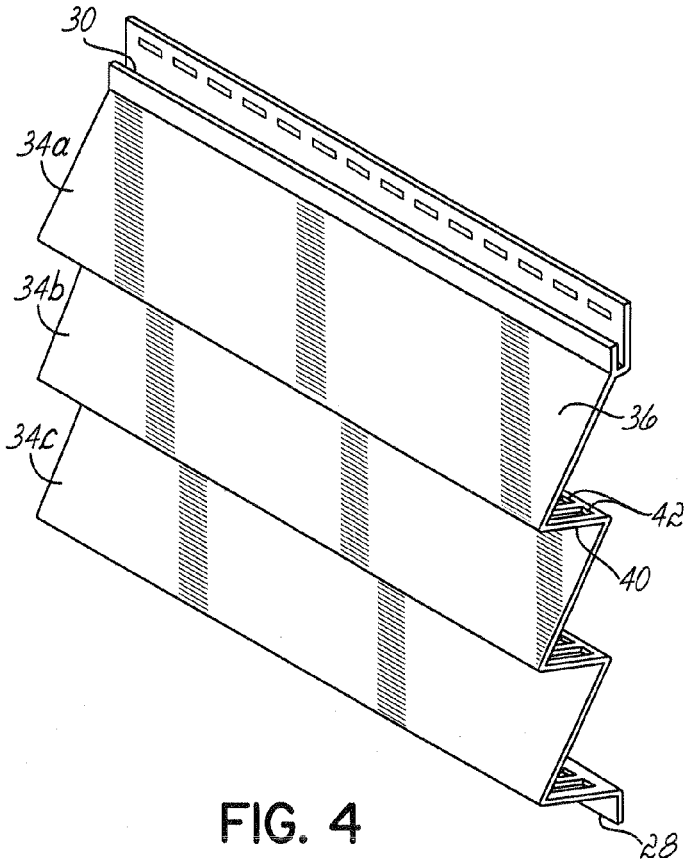
FIG. 4 is a perspective view of a vent panel for use in the present invention.
Figure 5:
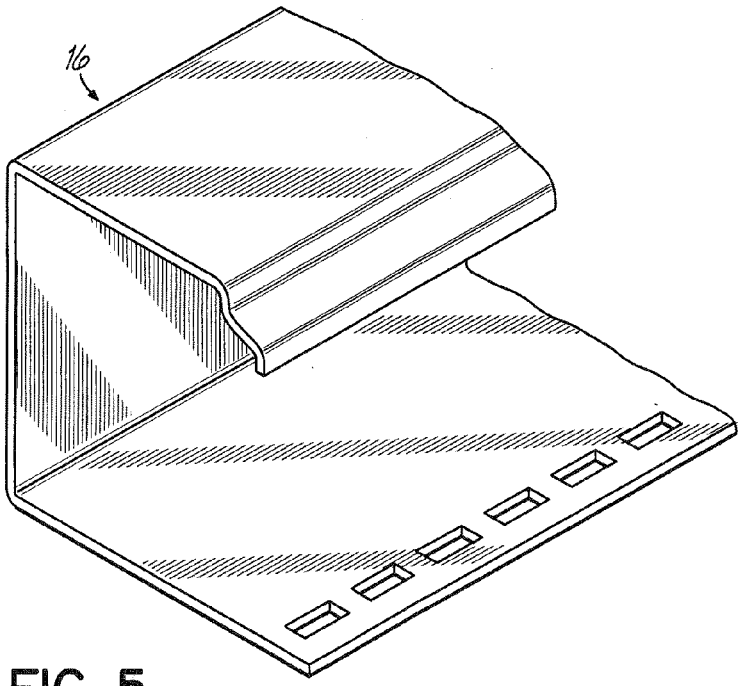
FIG. 5 is a perspective view of a J channel for use in the present invention.
Figure 6:
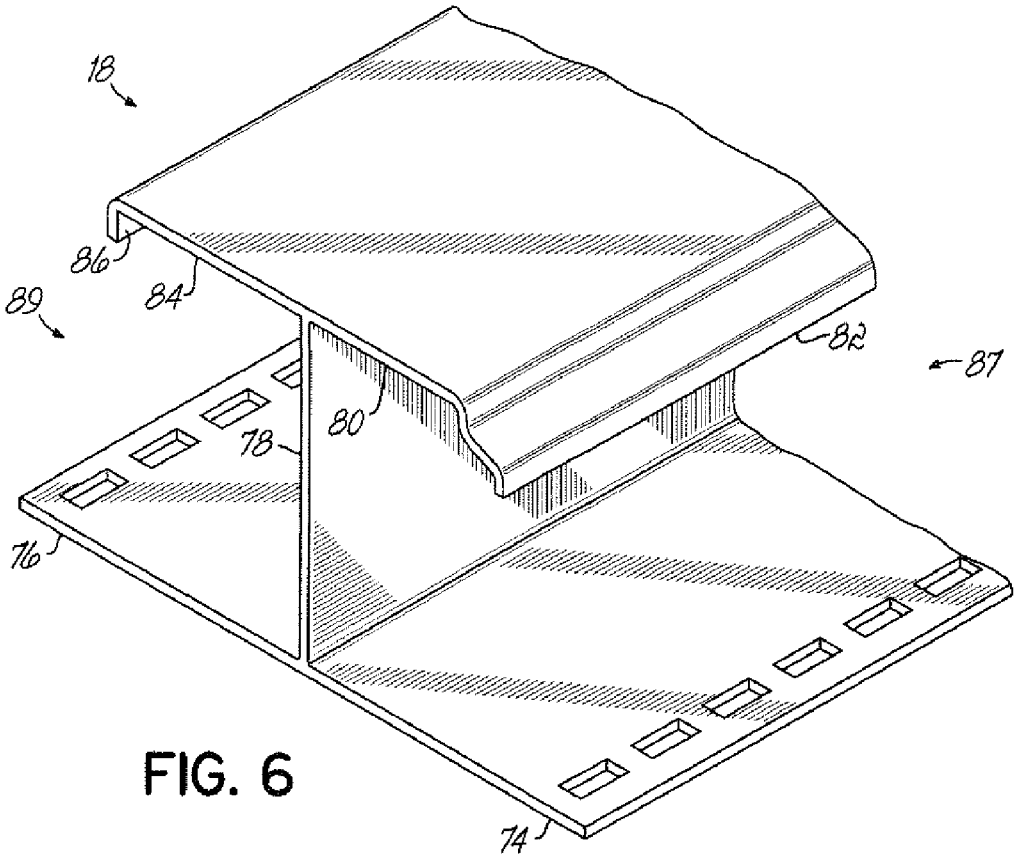
FIG. 6 is a perspective view of a T channel for use in the present invention.
Figure 7:
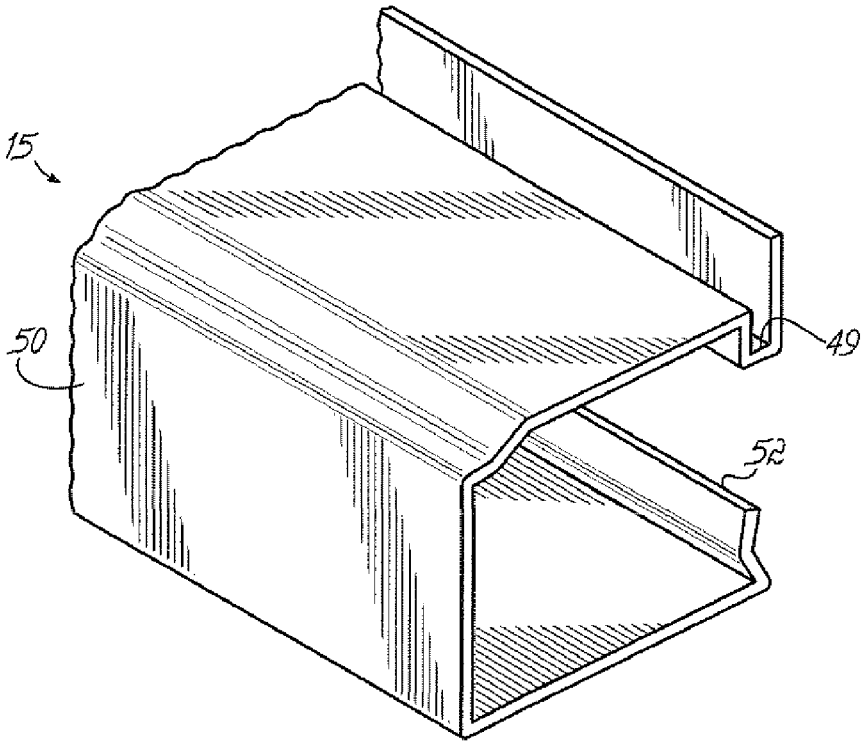
FIG. 7 is a perspective view of the bottom channel for use in the present invention.

The gable vent is formed from a combination of the slatted panels 14, lower trim section 15, T channels 18, and/or J channels 16, which are cut to the desired shape and size. As shown in FIG. 3, the vent 10 includes two upper J channel sections 16 that abut the soffit 62 of the building. These sections 16 are formed with mitered cuts. A section of lower trim section 15 forms the lower portion of vent 10. As shown, the remaining side portions of the trim frame are formed from two T channel sections 15, again formed with mitered cuts to establish a continuous frame. The central portion of the gable vent 10 includes upper and lower vent panels 57 and 58. In this embodiment, only two vent panels 14 are shown. If needed, one to four, or more vent panels 14 could be employed in a single vent. The vent panels 14 are cut, as shown, to the desired shape.

The individual sections are then assembled. The lower edge 52 of lower trim section 15 fits into the upper connecting edge 43 of siding 56. The frame members, the two J channels 16, lower trim section 15, and the two T channels 18, are nailed in position first by extending nails or other fasteners through the nailing flanges of the respective trim members. Next, the lower vent panel 58 is placed in position with its lower edge in channel 49 of section 15. It can be nailed or fastened to the wall by fasteners that extend through nail flanges of vent panels 14 into any support structure in the wall 12.

The support structure may be plywood along the peripheral edges where the vent panel 14 is located, or may be two-by-four structures located behind where the vent 10 will be located. The second, or upper, vent panel 57 is then slid into position with the lower edge 28 fitting within the channel 30 of the upper edge 26 of the vent panel 58. A fastener (not shown) can be extended at an angle through the upper most edge of the vent panel, again into some supporting wood structure behind the vent structure.

The remaining siding 56 is attached to the side wall 12 in a typical manner, with edges of the siding 56 fitting within the outer channel 89 of the T channels 18, forming a finished edge. This will complete the siding on wall 12. If T channels are not employed, the entire vent can be surrounded by J channel sections, and separate J channels can be used where siding abuts the vent. The vent can also be used adjacent brick or stucco, or any other wall surface.

Figure 8:
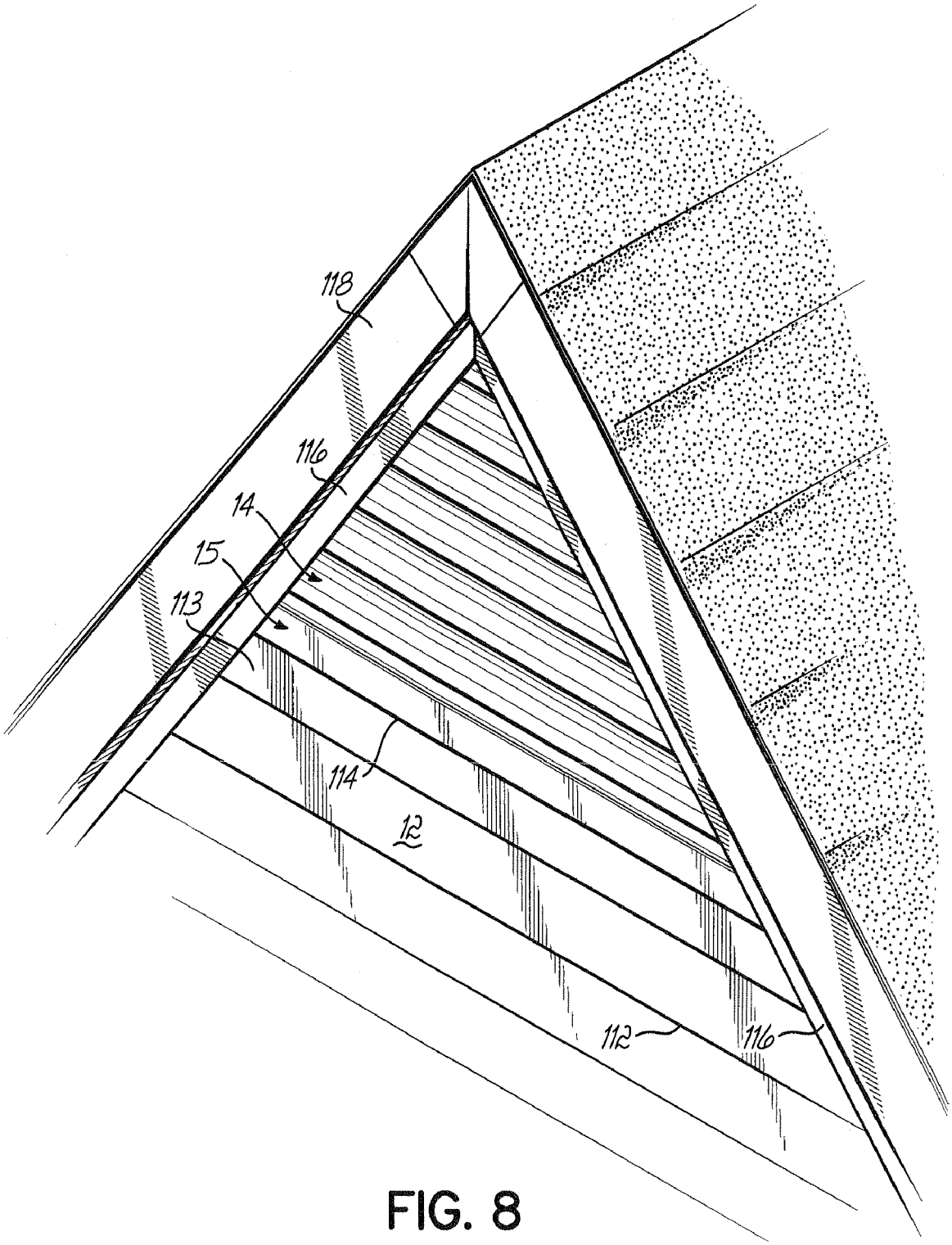
FIG. 8 is a perspective view of an alternate embodiment of the present invention.

FIG. 8 shows an alternate embodiment of the present invention. In this embodiment, the slatted panels 14 are fastened to the side of the wall 12 in the same manner as siding. As shown in this drawing, siding 112 is positioned on the building. A strip 114 of the lower trim section 15 is attached to the upper edge of the upper course 113 of siding. Courses of the vent panels 14 are then attached with J channel 116 between the upper edge of the panels 14 and the soffit 118.

The present invention enables one to assemble a custom-sized and shaped gable vent on site. The formed gable vent will have the appearance of a pre-formed gable vent, but should not be nearly as expensive as a factory-assembled, custom, gable vent. Because the vent is formed on site, there would be no delay. Further the present invention allows one to provide venting on any area where vinyl siding could be use. This also allows the builder to custom build any size or shape vent on the job site. This provides flexibility and avoids construction delays.

This has been a description of the present invention along with the preferred method of practicing the present invention. However, the invention itself should only be defined by the appended claims.

What is claimed is:

1. A composite wall vent comprising a plurality of interlocking vent panels;

said vent panels including an upper edge and a lower edge said upper edge having an elongated continuous nail flange and an upwardly open channel said channel being coplanar with an outer surface of said nail flange;

said lower edge comprising an elongated flange adapted to fit into an upper channel of an adjacent vent panel;

a lower trim member said lower trim member including a body portion and a lower bottom edge said bottom edge having a leg extended upwardly toward said vent panels, and approximately coplanar with said back surface of said composite wall vent and thereby being adapted to connect to an upper connecting edge of vinyl siding said trim member further having an upper edge said upper edge comprising a nail flange portion coplanar with said back surface of said composite wall vent and an upwardly open channel coplanar with an outer surface of said flange portion said channel portion adapted to receive said bottom edge of said vent panel.

2. The composite wall vent claimed in claim 1 comprising a plurality of interengaged vent panels.

3. The composite vent claimed in claim 2 wherein said vent panels include a plurality of slats said slats including outwardly extended portion and inwardly extending portions said inwardly extended portions having a plurality of vent slots.

4. The vent claimed in claim 1 further comprising T channel trim members on side portions of said vent panels.

5. The vent claimed in claim 1 wherein said vent further comprises J channel portions concealing upper edges of said vent panels.

* * * * *